US008281925B2

(12) United States Patent
Chang

(10) Patent No.: US 8,281,925 B2
(45) Date of Patent: Oct. 9, 2012

(54) SAFETY SPANNER SUSPENSION STRUCTURE

(76) Inventor: Chi-Tsai Chang, Taichung (TW)

( * ) Notice: Subject to any disclaimer, the term of this patent is extended or adjusted under 35 U.S.C. 154(b) by 8 days.

(21) Appl. No.: 13/050,925

(22) Filed: Mar. 17, 2011

(65) Prior Publication Data

US 2012/0074009 A1 Mar. 29, 2012

(30) Foreign Application Priority Data

Sep. 28, 2010 (TW) ..... 99218728 U

(51) Int. Cl.
*B65D 85/00* (2006.01)

(52) U.S. Cl. ..... 206/378; 206/349; 206/493; 206/495

(58) Field of Classification Search ..... 206/349, 206/493, 376, 806, 495, 378; 211/70.6
See application file for complete search history.

(56) References Cited

U.S. PATENT DOCUMENTS

| | | | | |
|---|---|---|---|---|
| 6,375,005 | B1 * | 4/2002 | McCann | 206/349 |
| 6,409,015 | B1 * | 6/2002 | Hu | 206/378 |
| 6,464,840 | B1 * | 10/2002 | McCann | 206/349 |
| 6,883,767 | B1 * | 4/2005 | Huang | 248/317 |
| 7,648,029 | B2 * | 1/2010 | Chen | 206/376 |
| 2008/0272017 | A1 * | 11/2008 | Chang | 206/349 |
| 2009/0026105 | A1 * | 1/2009 | Wu | 206/495 |

* cited by examiner

*Primary Examiner* — David Fidei
(74) *Attorney, Agent, or Firm* — Leong C. Lei

(57) ABSTRACT

A safety spanner suspension structure is provided for suspending a slender box-end ratchet spanner in an easy and safe insertion-retained suspended form for exhibition. The suspension structure includes an upper portion suspension board and a lower portion suspension seat. The suspension seat forms a seating hole that receives and is for engagement with a retention seat that forms alternately arranged projection tabs. The body of the retention seat forms an open slot for easy insertion into the seating hole for positioning purposes. A ring hole of the spanner is set on the outer side of the retention seat and a retention member is fit from the outside through the ring hole of the spanner to fit into the retention seat to have a post of the retention seat fit into the open slot of the retention member.

13 Claims, 6 Drawing Sheets

SAFETY SPANNER SUSPENSION STRUCTURE

TECHNICAL FIELD OF THE INVENTION

The present invention generally relates to a safety spanner suspension structure, wherein mainly, the suspensions structure comprises, in a lower potion thereof, a suspension seat that forming a through seating hole for receiving a separately made retention seat to fit into the seating hole, and a retention member being then set through a spanner positioned on the front side of the retention seat for insertion and positioning, so that a post projecting from the bottom of the retention seat can directly fit into an opening of a centrally-formed open slot of the retention member to assemble the spanner thereto and thus the retention member can securely fit and fixed to achieve the purposes of use for insertion, fixing, and theft resistance in suspended exhibition of the tool.

DESCRIPTION OF THE PRIOR ART

A small hand tool, such as a box-end spanner, is commonly directly included in a tool case as an accessory for packaging and sale. However, for a special tool, such as a ratchet spanner, it is provided to be used by a user in a desired way and must be selected according to the desired specification. To allow easy inspection by the consumers, a suspended package is often designed. For a regular spanner, inspection is often made for the working hole that is used for performing assembling operation. However, for a ratchet controlled box end spanner, the feature is the unique ratchet based rotation control. Due to the need for inspection of the ratchet spanner in a suspended condition, the conventional way of looping the spanner head for packaging and suspension does not allow rotation for inspect. Although recently, rotation inspection can be made for some adjustable wrenches for inspect at fixed angles, yet the structure is extremely complicated and the rotation angle is very limited after a handle is inserted. In addition, considering the desire for theft resistance, a suspension board must be designed as a curved plate having a substantially triangular shape that is of a great surface area. This makes the packaging cost high and imposes a severe limitation to the rotation inspection angle. For general consumers that wish the purchase the spanners, this is an obstacle for the purchase. Further, the suspended exhibition is not a secure way of use and thus troubles the industry. Thus, it is desired to ensure use safety of exhibition of box-end ratchet spanner in a suspended form and further improvement is needed in the respect of suspended package of tools.

SUMMARY OF THE INVENTION

In view of the drawback of the existing box-end ratchet spanner suspension structure that does not meet the practical needs for suspended package, the present invention aims to provide a safety spanner suspension structure, which comprises a suspension seat having a bottom forming an insertion seating hole to receive direct insertion of a retention seat that is of a resiliently openable/closable arrangement therein, wherein by properly positioning a spanner; a retention member is inserted from the outside in a nailing and fixing fashion. A post formed in the bottom of the retention seat is directly fit into and fixed in an open slot of the retention member so as to realize insertion positioning for suspension of tool without any potential risk of detachment, thereby effectively improving the impractical drawback of the existing spanner suspension structure lacking the function of theft resistance.

A primary objective of the present invention is that a suspension seat forms in a lower portion thereof a seating hole for receiving insertion of a retention seat, whereby by properly positioning a spanner in a relatively inserting operation, a retention member is set to penetrate from the outside therethrough for fixing so that a post projecting from the bottom of the retention seat can be fit into a resilient open slot of the retention member to realize easy and firm insertion and fixing and achieving a practical purpose of anti-theft security for suspended exhibition of spanner.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention, will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
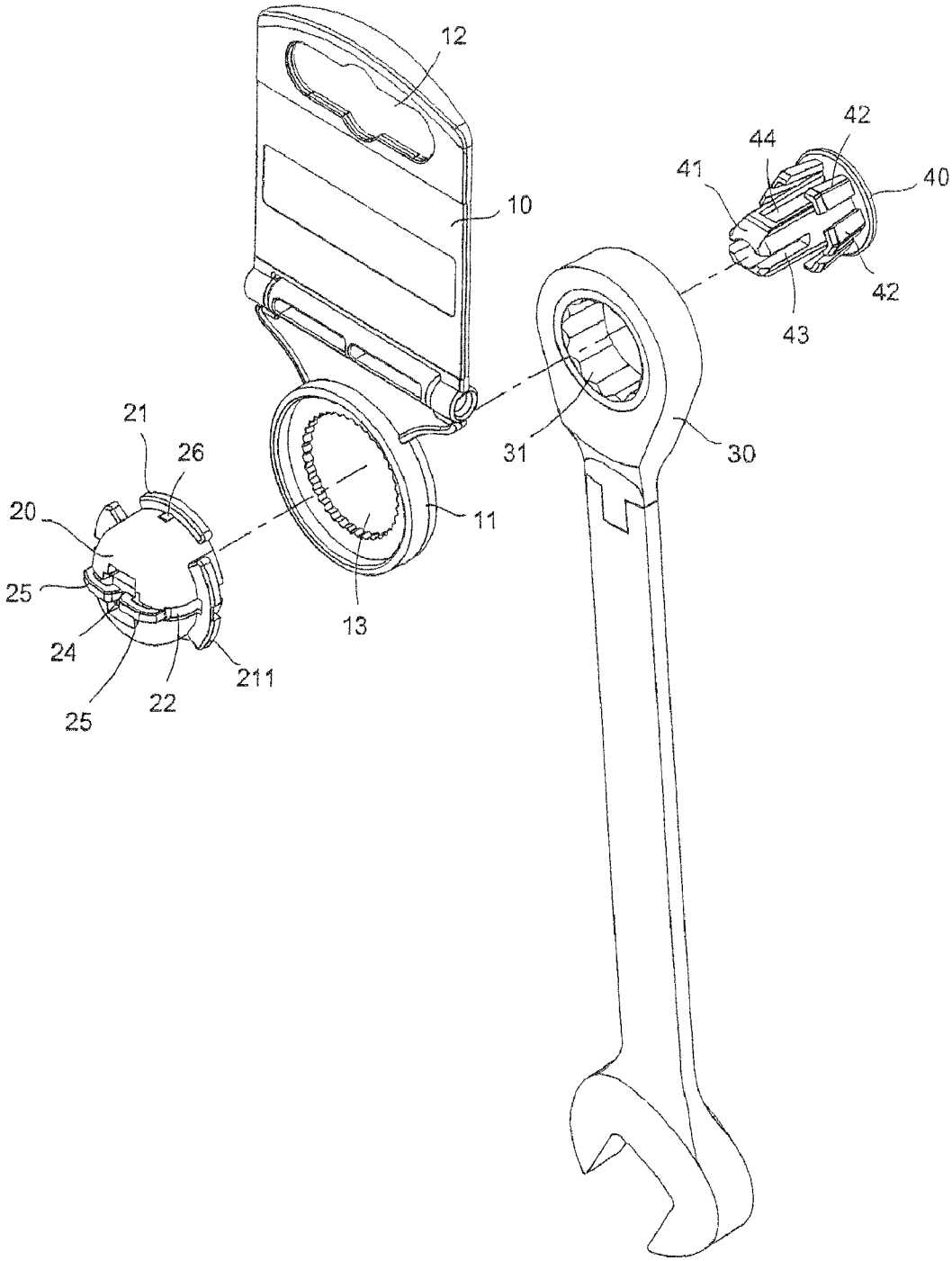
FIG. 1 is an exploded view showing a suspension structure according to the present invention.
Figure 2:
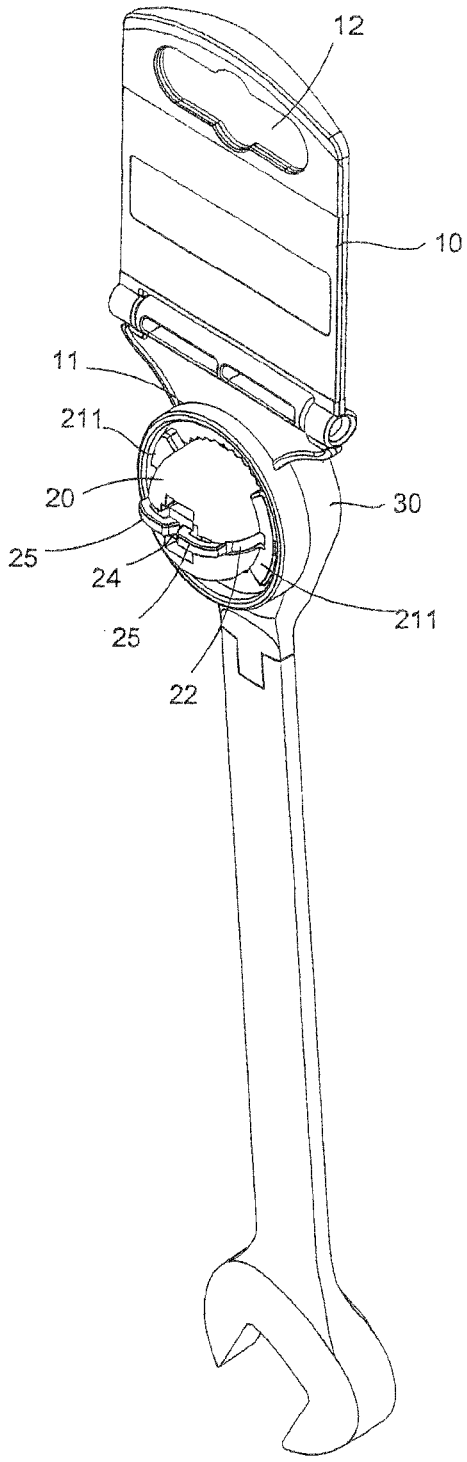
FIG. 2 is a perspective view showing the suspension structure of the present invention in an application of suspending a spanner.
Figure 4:
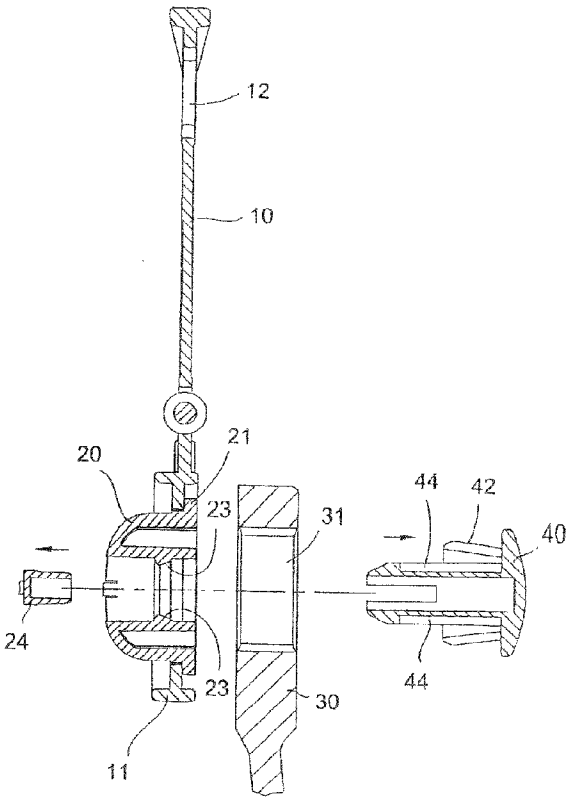
FIG. 4 is a cross-sectional view showing the suspension structure of the present invention in an anti-theft means cut-off condition for removing the spanner.
Figure 3:
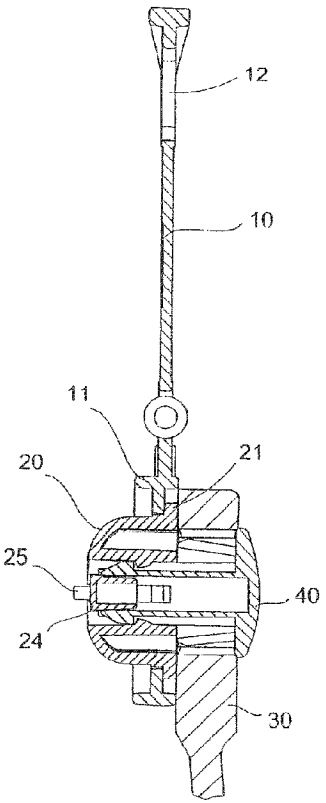
FIG. 3 is a cross-sectional view showing the suspension structure of the present invention in an inserted condition for suspending a spanner.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention provide a safety spanner suspension structure, which as shown in FIGS. 1-4, is an improvement of a box-end spanner suspension structure that presents an aesthetic back type covered design for suspension structure. The suspension structure comprises a suspension board 10. The board comprises a lower portion that is designed as a suspension seat 11 and the suspension board 10 and the suspension seat 11 are arranged in a pivotal joint condition to facilitate folding or for easy adjustment of deviation angle for suspension. The suspension board 10 has a top edge that forms an elongate hole like through hole 12 for suspension purposes. The suspension seat 11 has a central portion that is designed as a through seating hole 13 for insertion purposes. An inner circumference of the hole is made as a line-up arrangement of fine serration teeth. A hollow retention seat 20 is arranged as a projecting hemispheric body. The seat body forms, from a lower end on an outer circumference thereof, a plurality of retention projection tabs 21, 211 that are circumferentially spaced from each other along circular curves and are projecting outward, and are arranged in two rows that are respectively circumferentially lined up in an alternate manner. The retention seat 20 has a middle portion that forms a through spacing slot 22 to make the seat body a combination of two halves of upper and lower parts. Locations on inside circumferences of the seat body that oppose each other are provided with positioning flanges 23 that project inward. The spacing slot 22 is provided, at a location close to a central portion of a convex curve of the seat body, with a post 24 that projects inward and is assembled in a suspended condition in a slot hole. Two sides of the post are respectively connected to side middle portions of the slot by connection bars 25 that project in an outward curved form to form a design of fixing point on a middle section of the spacing slot 22 between the upper and lower seat body halves and also effectively form positioning mechanism for the suspended assembly for fixing the post 24. To insert the retention seat 20 into the seating hole 13, the lower edges of the opposing halves of the seat body allow for slight depression of the spacing slot 22 to show a nearly closed condition, and then the front projection tabs 21 can be easily moved through the circumferential surface of the seating hole 13. This, together with the spaced rear row of projection tabs 211, forms a mutual interposition assembling of the retention seat 20 from the inner and outer sides and in an alternate form, whereby the seat body 20 can be securely positioned and assembled. A ring hole 31 of a slender spanner 30 is relatively positioned to fit over an outer side of an end edge of the retention seat 20 that is so assembled through insertion, and a retention member 40 that is separately formed in advance by being collectively composed of a central fixing insertion peg 41 and circumferentially arranged and spaced positioning tabs 42 is fit from the outer side of the spanner 30. The fixing insertion peg 41 is formed, centrally, in a form of open slot 43. Upper and lower sides of the peg are respectively provided, corresponding to the locations where the flanges 23 of the retention seat 20 are to be inserted and assembled, with recessed engagement grooves 44 to allow the retention member to insert into the inner circumference of the retention seat 20 by penetrating through the spanner 30 from the outside to the inside, making the circumferentially arranged positioning tabs 42 engaging a circumferential edge of the ring hole 31 to realize mutual retaining engagement and thus achieve assistance for insertion positioning. To realize the assistance for resilient engagement and further facilitate interchangeable insertion of tools of close specifications, the positioning tabs 42 have insertion ends that are arranged as a resiliently openable/closable configuration in a slightly flaring form. The opening of the central open slot 43 of the insertion peg 41, in assembling, is exactly fit over and thus positioned by the curvedly-round-ended and inward-projecting post 24 of the retention seat 20, and the grooves 44 that are opposite and arranged on upper and lower sides of the insertion peg 41 are exactly in retained engagement by the inner flanges 23 of the seat body for positioning, so that the whole suspension and insertion and assembling structure can be reliably retained. Before the retained engagement is not released, the inserted and assembled and suspended tool can not be removed for use. This makes the suspended exhibition of tool truly achieving the purposes of theft resistance and exhibition safety.

As to the design for mutual retention engagement between the retention member 40 and the retention seat 20 according to the present invention, the whole insertion and retention design can alternatively arranged in the structural design as shown in FIGS. 5-8, wherein the seating hole 13 of the suspension seat 11 is arranged as a sink hole design that is slightly recessed from the insertion back side and the recessed seating hole 13 has a circumference surface that forms a design of fine serration toothed surface and an outer circumference on the back side of the seat body forms a stepped slot 14 having a greater diameter, the diameter corresponding to an end edge of the retention seat 20 to allow the end edge of the retention seat 20 to be easily fit into and retained by means of formation of a raised plate or a preformed mating engagement raised step 27. The seat body has a convex curved central portion of a seat plate surface that is provided with a suspended post 24 that is supported in a slot opening in a spaced manner and is arranged to project inward the seat body by a predetermined length, the slot spacing between the post body and the seat plate surface being properly connected and fixed by connection bars 25, so that in suspension, the ring hole 31 of the spanner 30 is positioned exactly outside the insertion seating hole 13 and then the retention member 40 uses the central insertion peg 41 thereof and the resiliently openable/closable arrangement that is hollow and forms, in the end thereof, the open slot by being slitting, in combination with a pawl end 45 that is provided as a barb in a circumferential surface on a top end of the peg body, to penetrate through the ring hole 31 and directly fit to and engage with the circumferential edge surface of the seating hole 13. This, together with the centrally projecting post 24 of the retention seat 20 directly fit into the inner circumference of the hollow slot opening of the insert peg 41, makes the peg end inoperable for resiliently opening/closing, thereby eliminating the concern of use in respect of unexpected deformation and thus separation in a suspended condition and ensuring the achievement of secure suspended exhibition in suspending the spanner 30.

Figure 5:
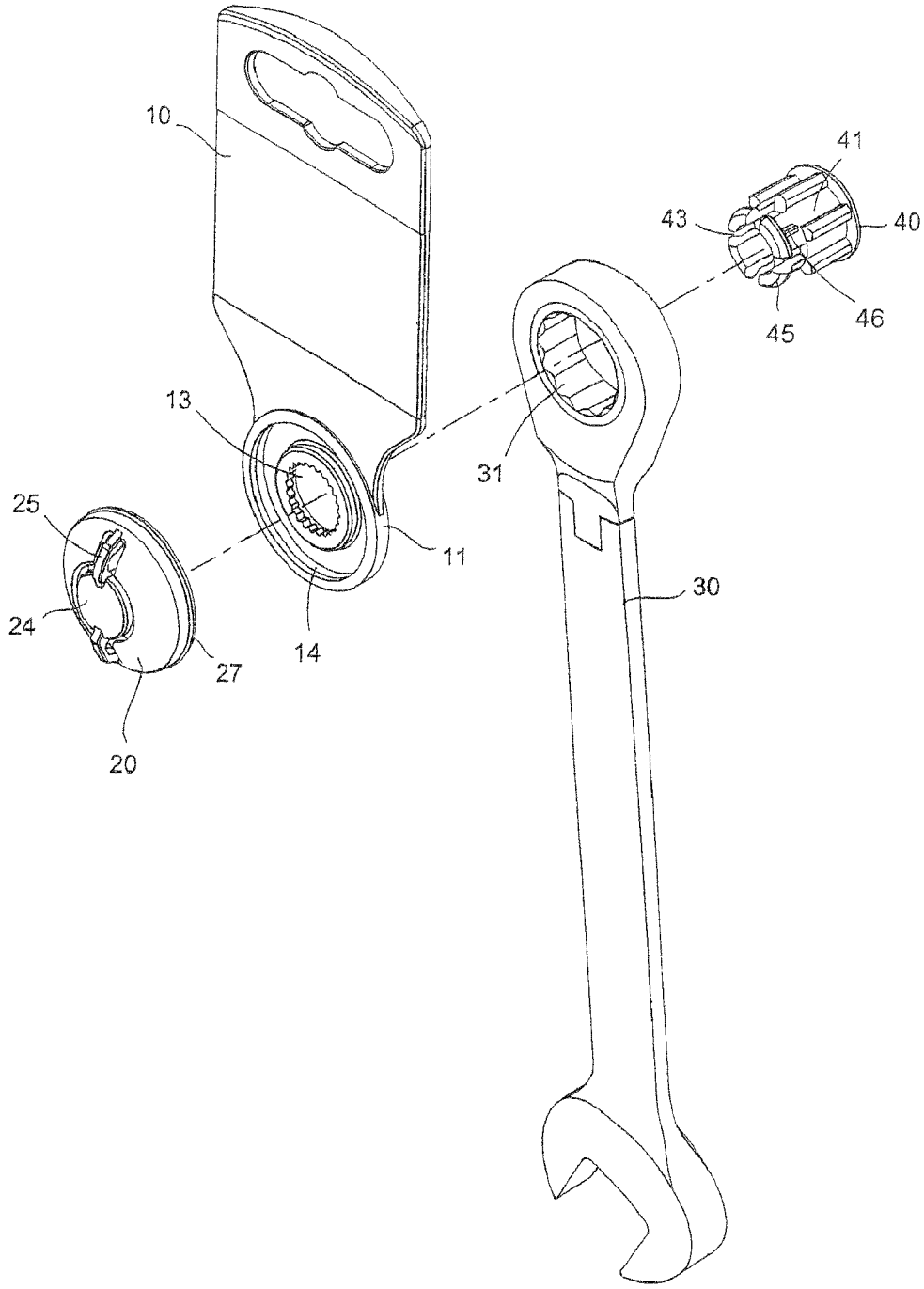
FIG. 5 is an exploded view showing another suspension structure according to the present invention.
Figure 6:
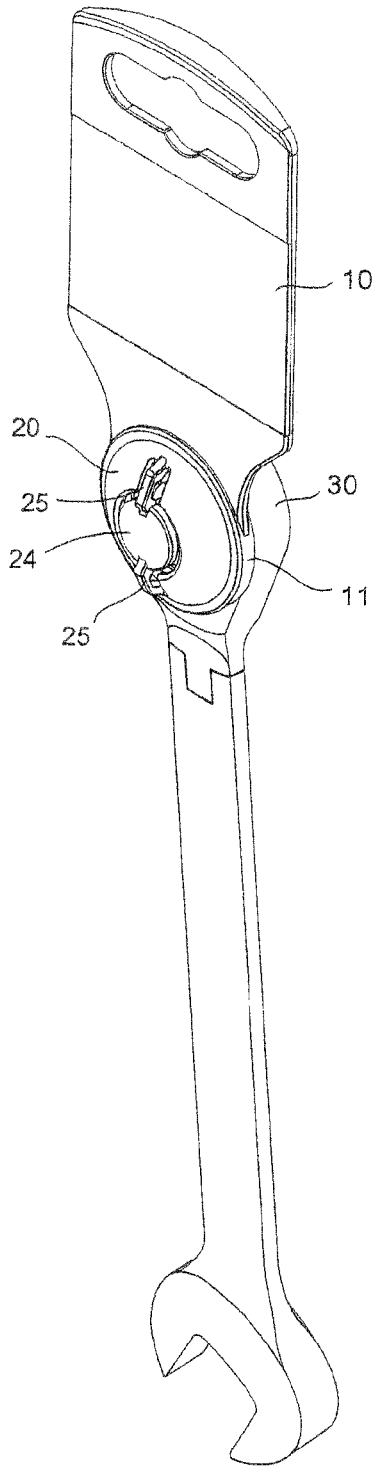
FIG. 6 is a perspective view showing the suspension structure of FIG. 5 in an application of suspending a spanner.
Figure 8:
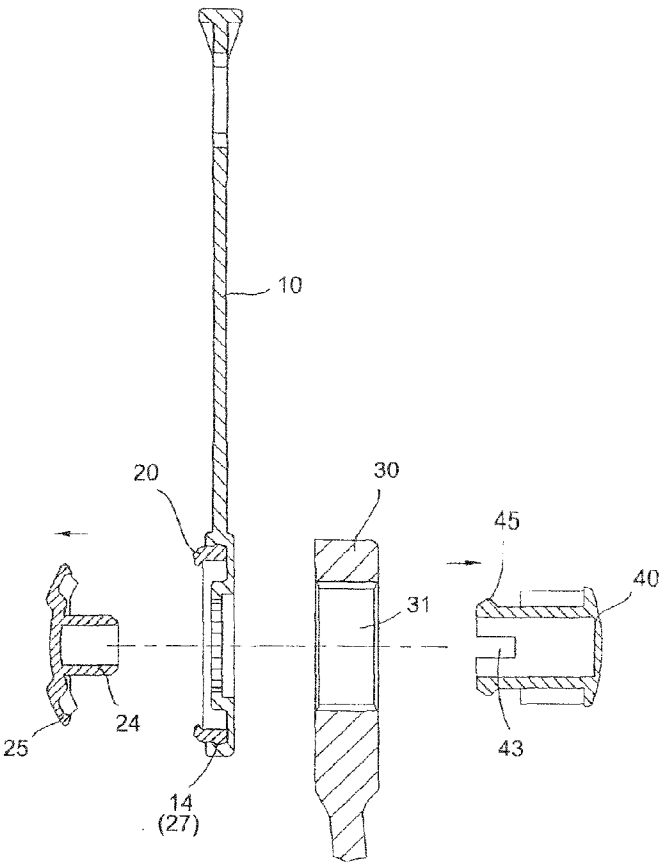
FIG. 8 is a cross-sectional view showing the suspension structure of FIG. 5 in an anti-theft means cut-off condition for removing the spanner.
Figure 7:
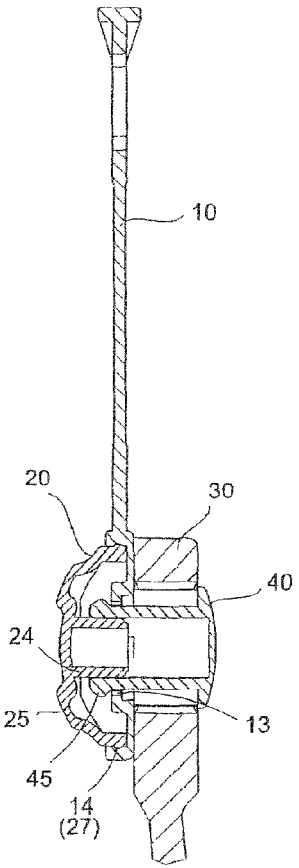
FIG. 7 is a cross-sectional view showing the suspension structure of FIG. 5 in an inserted condition for suspending a spanner.

Through the pivotal joint of the suspension board 10 to the suspension seat 11 according to the present invention, the seating hole 13 is provided for receiving insertion and assembly of the retention seat 20 that allows for insertion and fixing for suspended use of a spanner 30 through the easy insertion of the retention member 40. The easy insertion and assembling, together with the post 24 on the convex-curved bottom of the retention seat 20 fitting into and fixing the retention member 40, makes the insertion, assembling, and suspension of the spanner 30 realizing the advantages of secure suspended exhibition and theft resistance. The removal design for the theft resistance is using scissors to cut of the positioning-purpose connection bars 25 that are connected to the post 24 and then completely and readily removing the suspended post 24 to release the insertion and fixed condition, whereby theft resistance can be released and easy removal of the tool can be realized by removal of the inserted and assembled retention member 40 through the resiliently openable/closable arrangement of the open slot 43. To re-suspend the tool, the retention member 40 is re-inserted for retention and thus, repeated operations for secure suspension and easy retrieval can be realized. The design of fine serration toothed surface on an inner circumference of the seating hole 13, taking the embodiment shown in FIG. 1 as an example for description, only needs to provide slightly projecting ridge or raised spot 26 on the outer circumference surface of the retention seat 20, namely in an interposed ring surface between the two rows of projection tabs 21, 211, in order to cooperate with the serration toothed surface for engagement to realize rotation control, so as to provide a stepwise rotation operation resembling ratcheted operation during the rotation of the retention seat 20. Alternatively, as shown in FIG. 5, the raised spot 46 can be formed on a central cylindrical surface of the retention member 40 corresponding to the insertion location thereof to similarly provide the stepwise rotation control, whereby the suspended spanner 30, when suspended for exhibition, besides using the ratchet structure formed therein for rotation and inspection, may further use the retention seat 20 for rotation to adjust the assembled position thereof, achieving operations of swinging and adjusting, so that the suspension of slender tools, such as spanners, can achieve actual advantages of both security and exhibition. As regard to the design of the suspension structure, it is formed by readily assembling plastic components that are manufactured in advance. This provides an advantage of easy assembling and is an innovate design of suspension device of this kind available in the market.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A safety suspension structure for spanner comprising a suspension board and a suspension seat for insertion, assembling and suspension purposes, characterized in that the suspension seat forms, centrally, a seating hole for insertion therein of a retention seat that has a seat body forming, from a lower end on an outer circumference thereof, retention projection tabs that are circumferentially arranged and spaced from each other in an alternate form for retaining the retention seat in the seating hole, the retention seat forming, in a middle portion thereof, a through spacing slot to form an assembly of upper and lower parts, positioning flanges being formed at locations on inside circumference of the seat body and projecting inwards, a post being arranged at a central bottom of the retention seat and projecting inward and being supported in a suspended form by being connected by projecting connection bars, a spanner being positioned outside the retention seat to allow a retention member that is separately formed by being collectively composed of a central fixing insertion peg and spaced positioning tabs to fit from outside the spanner through the spanner to have recessed grooves formed in a peg surface receiving the flanges of the retention seat to fit and thus fix therein, the circumferentially arranged positioning tabs forming mutual positioning engagement with a ring hole of the spanner, the insertion peg having an open slot fit to the post located inside the retention seat for assembling, whereby suspended exhibition and theft resistance can be realized for secure insertion and assembling of spanner.

2. The safety suspension structure for spanner according to claim 1, wherein the seating hole of the suspension seat has an inner circumference forming an arrangement of fine serration teeth.

3. The safety suspension structure for spanner according to claim 1, wherein the suspension seat is pivotally connected to the suspension board.

4. The safety suspension structure for spanner according to claim 1, wherein two sides of the post are respectively connected to sides of the spacing slot by projecting connection bars to form a suspended assembly between middle portions of the slot and the post.

5. The safety suspension structure for spanner according to claim 1, wherein the circumferentially arranged positioning tabs of the retention member have insertion ends that are arranged as a resiliently openable/closable configuration in a slightly flaring form.

6. A safety suspension structure for spanner comprising a suspension board and a suspension seat for insertion, assembling and suspension purposes, characterized in that the suspension seat forms, centrally, a seating hole for insertion purposes, back side of a seat body of the suspension seat forming a stepped slot to allow an end edge of a retention seat to fit therein and retained thereby, the seat body forming, centrally, a suspended post that projects inward and is connected and fixed by projecting connection bars, whereby to suspend a spanner, the spanner is positioned outside the seating hole and the retention member is set through a ring hole of the spanner and fit into and engage with circumferential edge of the seating hole, the central post of the retention seat being directly fit into a hollow slot opening of the insertion peg to make the peg end inoperable for resiliently opening/closing thereby achieving secure suspended exhibition in suspending the spanner.

7. The safety suspension structure for spanner according to claim 6, wherein the seating hole for suspension purposes is arranged as a sink hole that is slightly recessed from the insertion back side.

8. The safety suspension structure for spanner according to claim 6, wherein the end of the peg is formed as pawl end that is provided as a barb.

9. The safety suspension structure for spanner according to claim 6, wherein the seating hole has an inner circumference forming an arrangement of fine serration toothed surface.

10. The safety suspension structure for spanner according to claim 6, wherein the central insertion peg of the retention member is hollow and has an end forming an end slot.

11. The safety suspension structure spanner according to claim 6, wherein the retention member has a cylindrical surface on which a raised spot is formed to engage serration teeth of the seating hole for realizing stepwise rotation control.

12. The safety suspension structure spanner according to claim 1, wherein the retention seat forms a slightly projecting ridge or raised spot between the rows of projection tabs for engagement with the serration teeth of the seating hole for realizing stepwise rotation control.

13. The safety suspension structure spanner according to claim 6, wherein the retention seat forms a raised plate or a mating engagement raised step to engage the stepped slot of the suspension seat.

* * * * *